US006685351B2

(12) United States Patent
Chen

(10) Patent No.: US 6,685,351 B2
(45) Date of Patent: Feb. 3, 2004

(54) INDICATOR LIGHT DEVICE OF A COMPUTER FRONT PANEL

(75) Inventor: Chih-chung Chen, Taipei (TW)

(73) Assignee: Portwell Inc., Taipei (TW)

( * ) Notice: Subject to any disclaimer, the term of this patent is extended or adjusted under 35 U.S.C. 154(b) by 196 days.

(21) Appl. No.: 09/945,841

(22) Filed: Sep. 5, 2001

(65) Prior Publication Data

US 2003/0043050 A1 Mar. 6, 2003

(51) Int. Cl.[7] ..... F21V 7/04

(52) U.S. Cl. ..... 362/555; 362/85; 362/27; 362/800; 340/815.42

(58) Field of Search ..... 362/555, 85, 800, 362/27, 26; 340/815.42, 815.43, 815.45

(56) References Cited

U.S. PATENT DOCUMENTS 5,387,901 A * 2/1995 Hardt ..... 340/815.42

5,504,660 A * 4/1996 Heidorn ..... 362/27

* cited by examiner

*Primary Examiner*—Stephen Husar

(74) *Attorney, Agent, or Firm*—Troxell Law Office PLLC

(57) ABSTRACT

The present invention of an indicator light device on a computer front panel has a light conduct post seat disposed on an indicating front panel on one side in a computer casing. The indicating front panel is a diaphanous panel body. Both sides of a light conduct post seat are inserted and protruded by a plurality of communicating light conduct posts. The outer ends of the light conduct posts are in convex shapes while the inner ends are concave shapes to allow the light source generated by the illuminant to be conducted outward as well as displayed by the indicating front panel. Through the implementation of the present invention, it is not necessary to drill extra holes on the indicating front panel when more temporary indicator light devices are required.

4 Claims, 6 Drawing Sheets

INDICATOR LIGHT DEVICE OF A COMPUTER FRONT PANEL

BACKGROUND OF THE INVENTION

1) Field of the Invention

The present invention of an indicator light device on a computer front panel relates to a computer casing with an indicating front panel furnished with several prepared light conduct posts for providing more display connection possibilities of additional functional indicator lights for any kind of computer casing, if necessary.

2) Description of the Prior Art

As shown in FIG. 1, on an indicating front panel (11) of a conventional computer casing (10) (an industrial computer in this exemplary embodiment), several fixed through holes (111) are disposed, so that certain required illuminants (20) (colored and illuminating diode bodies in this exemplary embodiment) can be inserted and protruded on the said computer casing (10) for indicating the current operation status.

Due to the rapid development for improvement of the design of a computer casing (10), it would be necessary for the computer casing manufacturers to use the current available indicating front panel (11) for researching and developing a new one in order to meet the new additional functions required. In such a case, the new added functions of a computer are regrettably not displayable on the said conventional computer casing (10) by the extra illuminants (20) since there are no extra through holes (111) available on the existing indicating front panel (11) for inserting the said illuminants (20). Therefore, during the R&D trial stage, the said indicating front panel (11) must be modified again in order to increase the number of the through holes (111) by drilling process for meeting the actual and temporary requirement, which in turn results increase of the manufacturing cost. Furthermore, not all of the said through holes (111) can be disposed at orderly locations. Even when the said illuminants (20) are not activated to illuminate, they are visible due to the through holes (111) are protruded directly on the indicating front panel (11), therefore, the elegance and integral style of the original design of the indicating front panel (11) is disappeared.

The present invention is intended to provide an improved device of indicator lights on a computer front panel, which mitigates and/or obviates the above problems.

SUMMARY OF THE INVENTION

It is an object of the present invention to provide an indicator light device on a computer front panel which may avoid to result any additional production cost for providing the required extra holes on an existing indicating front panel.

It is a further object of the present invention to provide an indicator light device on a computer front panel, which may provide distinct indicator lights as required.

The above objects can be achieved by providing the indicator light device on a computer front panel with the following special features:

Firstly, to install a light conduct post seat directly in a long slot on the indicating front panel on one side in the computer casing. Since the said indicating front panel is a diaphanous panel body, so a plurality of communicating and protruding light conduct posts can be inserted and both sides of the said light conduct post seat can be protruded for spare use. The outer end plane of the said light conduct post is in a convex shape and facing the outside of the computer casing, while the inner end plane is in a concave shape and facing the inside of the computer casing. Therefore, the light source generated by the activated built-in illuminant corresponding and adjacent to the inner end plane of the light conduct post can be concentrated and conducted outward from the outer end plane of the light conduct post. By means of a contrast screen formed by the diaphaneity of the indicating front panel and the said built-in illuminant, brighter lighting generated by the said illuminant through the light conduct post can be obtained more distinctly by the said indicating front panel.

Secondly, the said device can comprise a front panel decorative cover and a light conduct post seat, wherein, the front panel decorative cover is a diaphanous and long slot body; a light conduct post seat is disposed on the front panel decorative cover; both sides of the said light conduct post seat are inserted by a plurality of communicating and protruding light conduct posts; part of the said light conduct posts are for spare use; wherein, the light conduct posts with external convex planes are accommodated inside the long slots of the said front panel decorative cover; a plurality of insert holes are disposed near the end area of the said light conduct post seat; through the assembly of the mentioned parts, one long slot through hole disposed on the indicating front panel of on the end plane of the computer casing is penetrated by the closed end of the said front panel decorative cover; the rim of the convex plate of the said front panel decorative cover penetrates and interlocks with the said indicating front panel form the rear plane thereof to the front and positions on the rim of the long slot through hole of the said indicating front panel; then the insert hole of the said light conduct post seat is fixed onto the insert post on the rear plane of the said indicating front panel preventing the front panel decorative cover separating from the long slot through hole on the indicating front panel; the light source, generated by the activated built-in illuminant corresponding and adjacent to the inner end plane of the light conduct post, is conducted outward from the outer end plane of the light conduct post; via the contrast screen formed by the diaphaneity of the indicating front panel and the said illuminant, brighter lighting generated by the said illuminant through the light conduct post can be obtained more distinctly and displayed by the front panel decorative cover.

Another object of the present invention is to avoid directly seeing a plurality of protruded indicator lights inserted on the indicating front panel and to concern the integral style and the elegance of the indicating front panel; the built-in illuminant in the computer casing is pressed tightly against the inner end plane of the light conduct post for being away from the indicating front panel or the front panel decorative cover, thereby, the integral style of the indicating front panel or the front panel decorative cover can be maintained completely.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
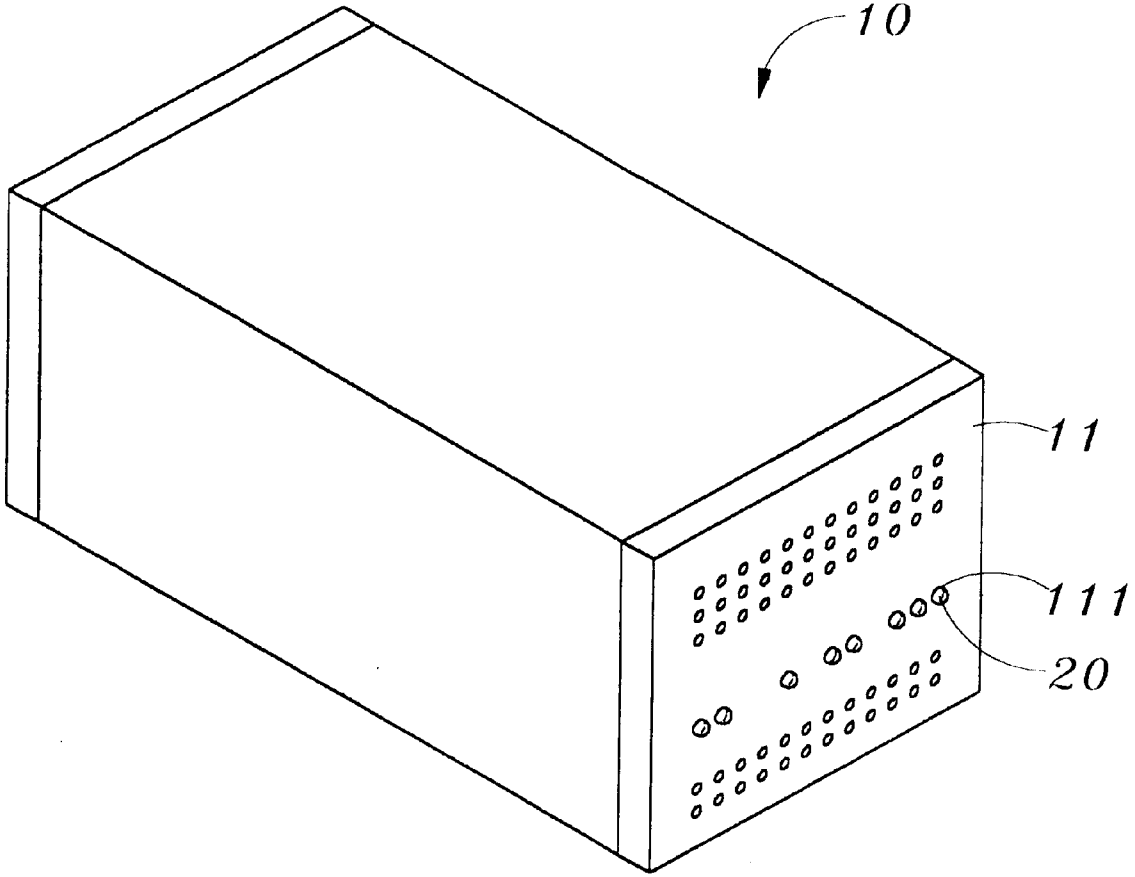
FIG.1 Prior Art
FIG. 1 is a pictorial drawing of conventional illuminants inserted on the indicating front panel of a computer casing.
Figure 2:
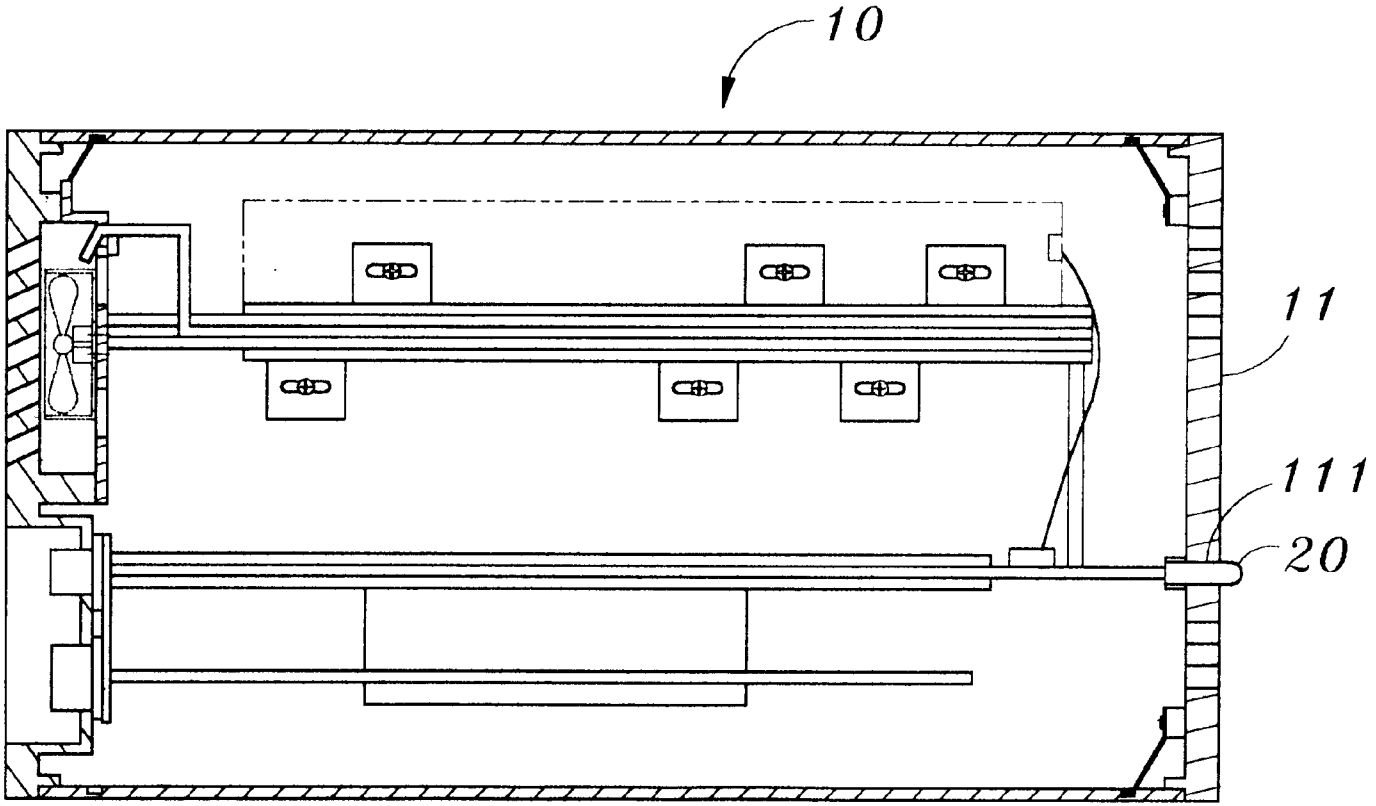
FIG.2 Prior Art
FIG. 2 is a lateral cross-sectional drawing of FIG. 1.
Figure 3:
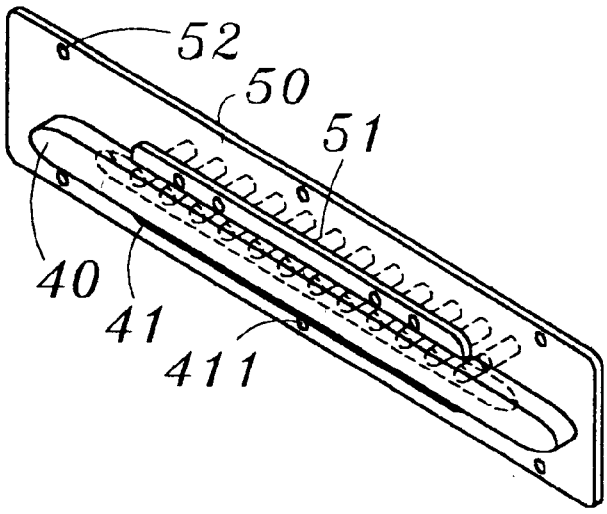
FIG. 3 is a pictorial drawing of the present invention.
Figure 4:
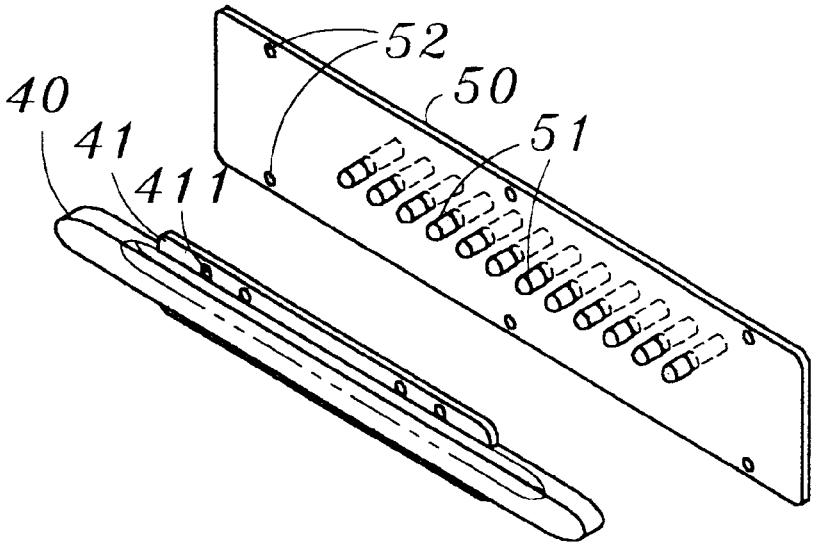
FIG. 4 is a pictorial and exploded drawing of the present invention.
Figure 5:
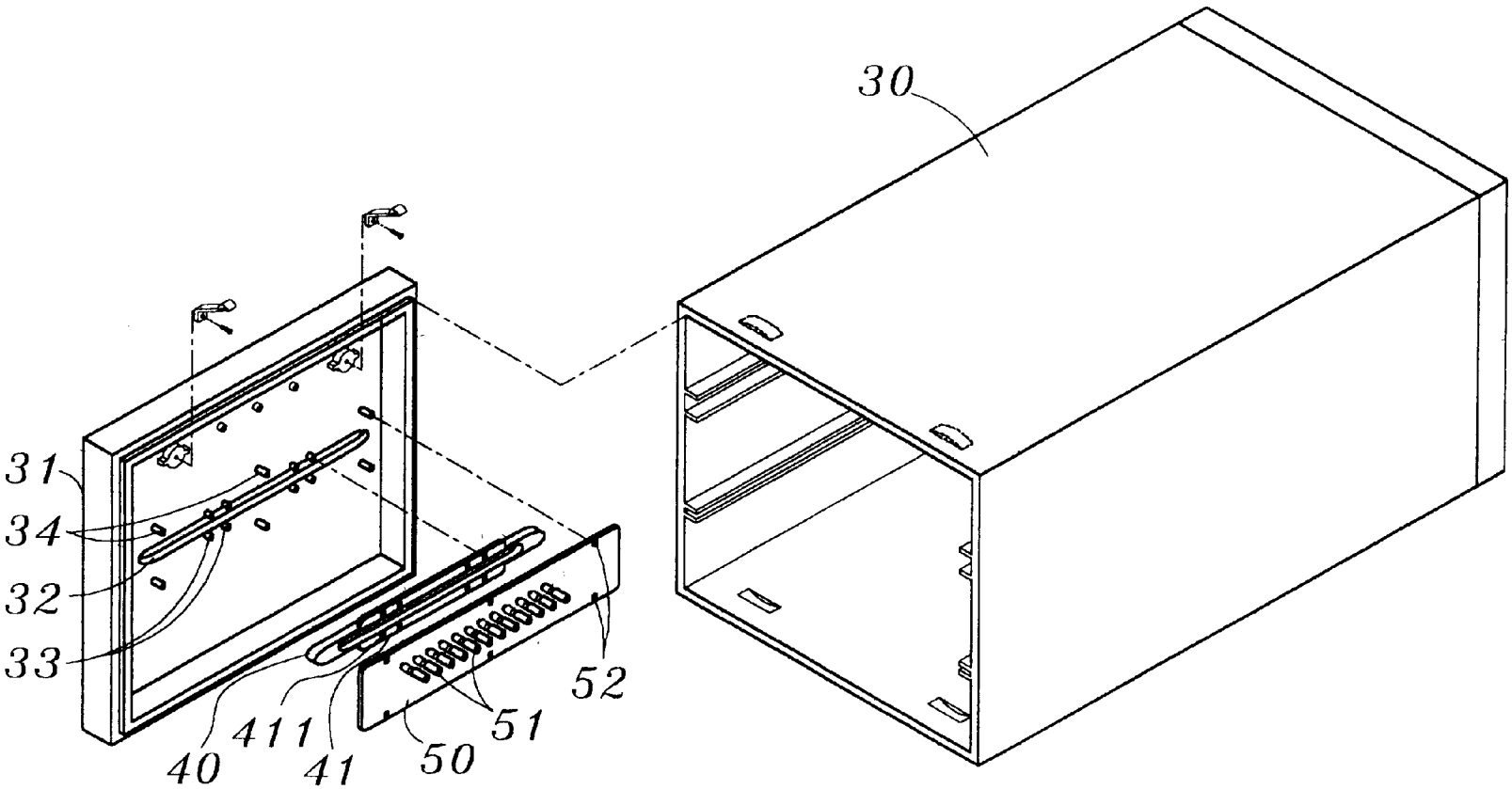
FIG. 5 is a pictorial and exploded drawing of an exemplary embodiment of the present invention.

Referring to the drawings and initially to FIGS. 3 to 6, the present invention of an indicator light device on a computer front panel is installed on an indicating front panel (31) on one side of a computer casing (30) (it is applied to an industrial computer in this exemplary embodiment, however, it can be applied onto any kind of computer front panel with displaying function). The indicator light device of the said computer front panel comprises mainly of a front panel decorative cover (40) and a light conduct post seat (50), wherein, the front panel decorative cover (40) is a diaphanous long slot body; a long slot through hole (32) in the shape similar to that of the front panel decorative cover (40) is disposed on a certain position on the said indicating front panel (31) for providing the insertion of the closed end of the said front panel decorative cover (40); at least one lateral end of the said front panel decorative cover (40) extends as an convex plate (41) to be disposed across outside but not protruding from the rim of the said long slot through hole (32); a plurality of positioning holes (411) disposed at certain locations on the said convex plate (41) interlock the positioning posts (33) on the indicating front panel (31) and corresponding to the positioning holes (411).

A plurality of communication light conduct posts (51) are orderly inserted into and protruded from both sides of the said light conduct post seat (50); an outer end plane of the said light conduct post (51) is in a convex shape and facing the outside of the computer casing (30); the inner end plane is in a concave shape and facing the inside of the computer casing (30); wherein, a light conduct post (51) with one end in a convex shape is accommodated inside the said front panel decorative cover (40); a plurality of insert holes (52) are disposed near the end area of the said light conduct post seat (50); the said insert holes (52) are firmly sleeved onto the insert posts (34) on the rear plane of the said indicating front panel (31), (can be adapted by the gluing, tight press-in and high frequency welding etc. processes), for blocking and preventing the said front panel decorative cover (40) from separating from the long slot through hole (32) on the indicating front panel (31); thereby, the light source, generated by the activated built-in illuminant (20), (a colored and illuminating diode body is used in this exemplary embodiment; however, for those skilled in the art, it can be replaced by other kinds of elements), corresponding and adjacent to the inner end plane of the light conduct post (51), is conducted outward from the outer end plane of the light conduct post (51) and is displayed by the said front panel decorative cover (40); through the implementation of the present invention, when the development of the computer casing (30) requires extra and temporary illuminants (20), all of the unused light conduct posts (51) can be selected for application; therefore, it is not necessary to drill any extra through holes on the said indication front panel (31), thereby, the expenses for manufacturing the indicating front panel (31) and for the molding in mass production can be saved; at the same time, the original and external pleasant appearance and integral style of the said front panel decorative cover (40) can be maintained.

Figure 6:
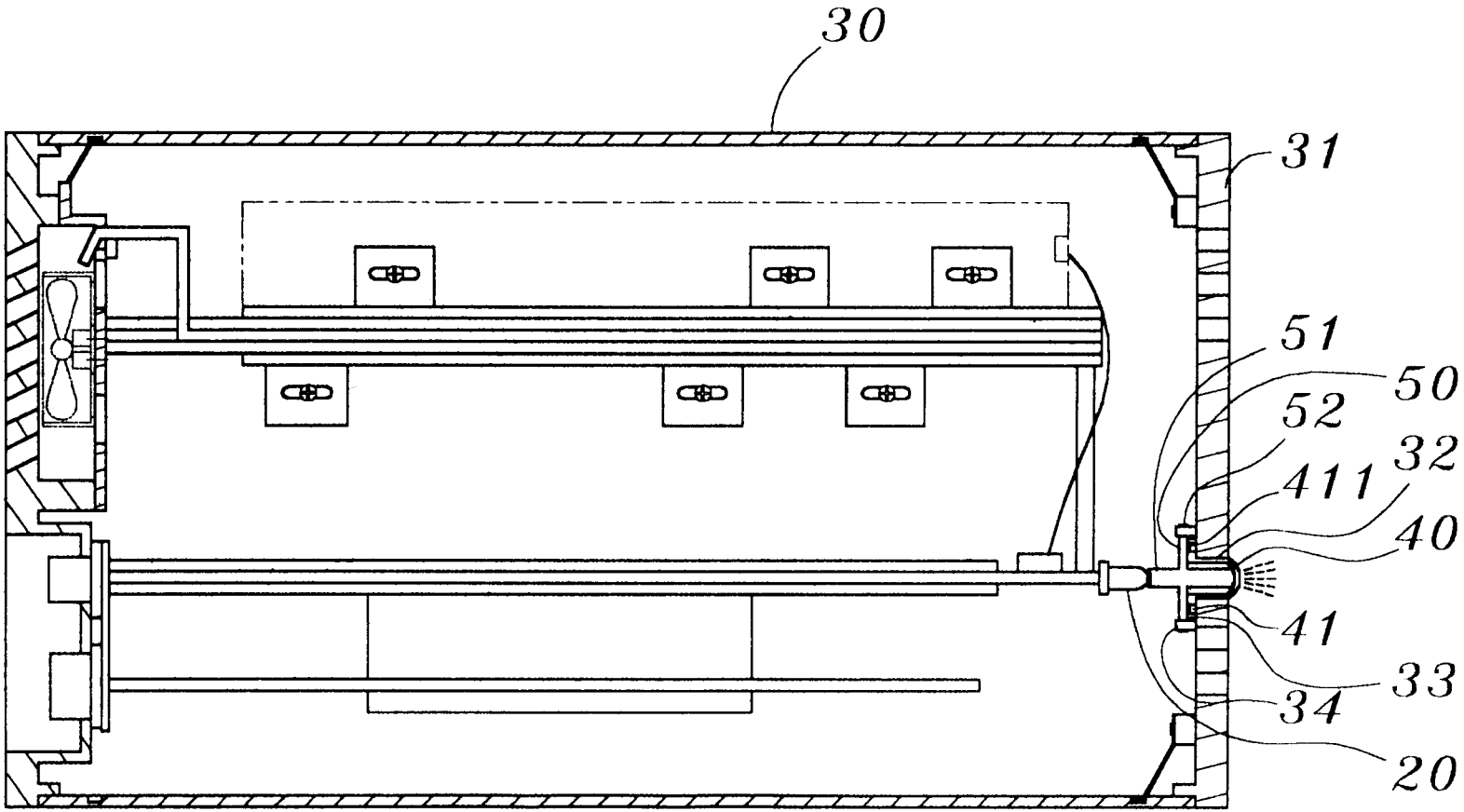
FIG. 6 is a cross-sectional drawing of an exemplary embodiment of the present invention.
Figure 7:
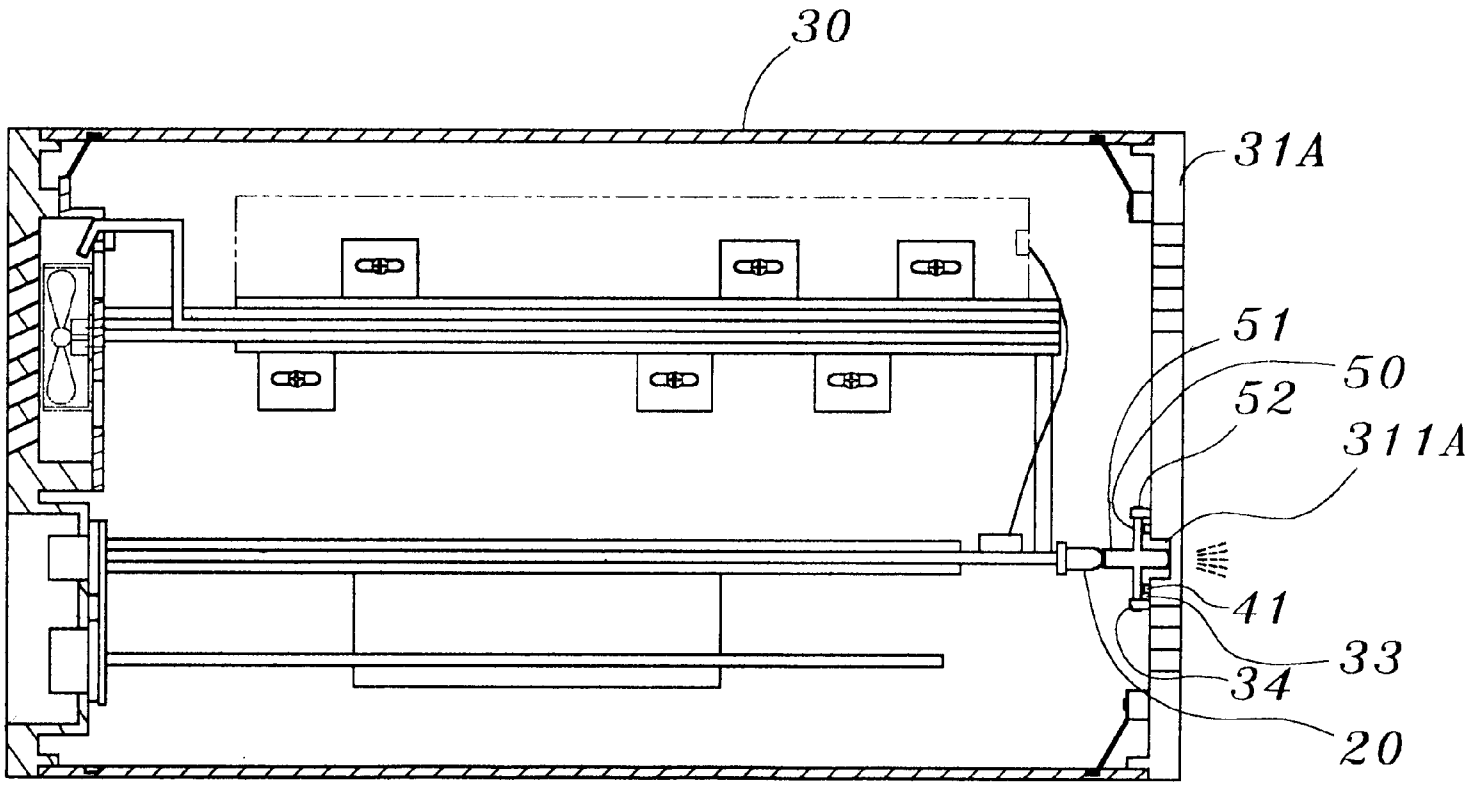
FIG. 7 is a cross-sectional drawing of another exemplary embodiment of the present invention.

Referring to FIG. 7, the cross-sectional drawing of another structural embodiment, to compare with the previous FIG. 6., the difference between them is whether there is a front panel decorative cover (40) disposed or not; the said indicating front panel (31A) is replaced by a diaphanous plate body with a long slot (311A) to allow the outer end plane of the light conduct post (51) on the said light conduct post seat (50) can be accommodated or fixed inside the said long slot (311A) and to allow the light source, generated by the activated built-in illuminant (20) corresponding and adjacent to the inner end plane of the light conduct post (51), can be conducted outward from the outer end plane of the light conduct post (51) and displayed by the said indicating front panel (31A), without loosing the original and external pleasant appearance and style of the indicating front panel (31A); the functions of those parts not being introduced are the same as that of the previous drawing.

According to the above description, it is appreciated that the present invention has the following advantages: original and innovative in its shape and configuration, increase of added functions and practical for application.

Although the invention has been explained in relation to its preferred embodiment, it is to be understood that many other possible modifications, and variations can be made without departing from the spirit and scope of the invention as hereinafter claimed.

What is claimed is:

1. An indicator light device on a computer front panel, comprising:

a front panel decorative cover of a diaphanous long slot body with at least one lateral end thereof extending as a convex plate;

a light conduct post seat, disposed with a plurality of communication light conduct posts inserted and protruded on both sides thereof to allow the outer end plane of the light conduct post to be accommodated inside the said front panel decorative cover; a plurality of insert holes are disposed near the end area of the said light conduct post seat;

after assembly of the mentioned parts, one long slot through hole disposed on the indicating front panel of the end plane of the computer casing is penetrated by the closed end of the said front panel decorative cover; the convex plate of the said front panel decorative cover penetrates and interlocks with the said indicating front panel forming the rear plane thereof to the front and positions on the rim of the long slot through hole of the said indicating front panel; then the insert hole of the said light conduct post seat is fixed on the insert post on the rear plane of the said indicating front panel preventing the front panel decorative cover separating from the long slot through hole on the indicating front panel; the light source, generated by the activated built-in illuminant corresponding and adjacent to the inner end plane of the light conduct post, is conducted outward from the outer end plane of the light conduct post and displayed by the front panel decorative cover.

2. An indicator light device on a computer front panel according to claim 1, wherein, one end plane of the light conduct post is in a convex shape while the other end is in a concave shape to allow the light sources of illuminants to be concentrated and conducted by the light conduct post.

3. An indicator light device on a computer front panel according to claim 1, wherein, the illuminant is a colored and illuminating diode body.

4. An indicator light device on a computer front panel according to claim 1, wherein, a plurality of positioning holes are disposed on the convex plate of the front panel decorative cover and the said indicating front panel has positioning posts disposed for interlocking.

* * * * *